US007507152B2

(12) United States Patent
Halliburton

(10) Patent No.: US 7,507,152 B2
(45) Date of Patent: Mar. 24, 2009

(54) BALL DROP AMUSEMENT GAME

(75) Inventor: Ronald Halliburton, Delray Beach, FL (US)

(73) Assignee: Benchmark Entertainment, L.C., Hypoluxo, FL (US)

( * ) Notice: Subject to any disclaimer, the term of this patent is extended or adjusted under 35 U.S.C. 154(b) by 112 days.

(21) Appl. No.: 11/514,909

(22) Filed: Sep. 5, 2006

(65) Prior Publication Data

US 2007/0057451 A1 Mar. 15, 2007

Related U.S. Application Data

(60) Provisional application No. 60/713,361, filed on Sep. 2, 2005.

(51) Int. Cl.
*A63F 9/02* (2006.01)
*F41J 9/00* (2006.01)

(52) U.S. Cl. ..... 463/7; 273/351; 273/389; 273/398; 273/402

(58) Field of Classification Search ..... 273/440, 273/351, 352, 355, 382, 389, 394–399, 402, 273/113, 120 R, 121 R, 123 R, 124 R, 142 A, 273/142 D, 142 E, 142 G, 138.3; 463/7
See application file for complete search history.

(56) References Cited

U.S. PATENT DOCUMENTS 2,607,592 A * 8/1952 Finnerty ..... 273/110
3,083,019 A * 3/1963 Giuliano ..... 273/351
3,208,751 A * 9/1965 Kostka ..... 273/368
4,036,497 A * 7/1977 Garto et al. ..... 273/357
4,095,794 A * 6/1978 Garto et al. ..... 273/351
4,120,497 A * 10/1978 Goldfarb et al. ..... 273/351
4,126,309 A * 11/1978 Hicks et al. ..... 273/368
5,326,108 A * 7/1994 Faith ..... 273/355
7,192,342 B2 * 3/2007 Shoemaker, Jr. ..... 463/7

OTHER PUBLICATIONS http://www.foramusementonly.com/slamawinnerx/index.cfm, Website, Slam-A-Winner X-treme ball drop game, 2006.*

* cited by examiner

*Primary Examiner*—William M. Pierce
(74) *Attorney, Agent, or Firm*—Oliff & Berridge, PLC

(57) ABSTRACT

An amusement device that includes a horizontally oriented rotating wheel having a plurality of apertures through the wheel and a release mechanism that will release game pieces from a location above the wheel is disclosed. The game can be played by exercising skill or it can be configured to result in a random outcome. In the skilled based embodiment of the invention, a user tries to time the activation of the release mechanism so that a high energy ball drops down from the release mechanism and falls through the rotating wheel. If a ball passes directly through the wheel, the ball is detected by a detector that is positioned below the wheel and an award is provided to the player. In an alternative embodiment of the device, the device is designed to release a plurality of balls which will bounce and roll on the rotating wheel until they are captured in apertures that are provided through the wheel. Each aperture has a detector and if the balls are captured in pre-selected apertures, an award is provided to the player.

15 Claims, 10 Drawing Sheets

BALL DROP AMUSEMENT GAME

The present invention relates to an amusement game that may be operated in a first mode that allows for the exercise of skill by a player and in a second mode in which winning the game is an entirely random event. The object of the skill game is to time the activation of a ball release so that a ball falls from a guide tube through and opening provide though a rotating wheel. In the random game, a plurality of balls are dropped onto a rotating wheel and are allowed to bounce and roll until they are trapped in a depression or cavity provided in the wheel that is associated with a symbol or number. A sensor then detects the location of the balls in the wheel and sends a signal to a controller reflecting that the ball has come to rest in the particular location. The controller then determines if the location of the balls correlate with a predetermined winning combination. While the preferred embodiment involves the release of a ball and a rotating target, it is contemplated that other objects could be released to hit moving targets or fall through apertures.

BACKGROUND OF THE INVENTION

There is persistent demand for new games in both gaming establishments and general amusement centers such as arcades or family fun centers. It is generally accepted that customers are more likely to repeat visits to game centers if the game attractions provided by the operator are new and different. New games may also generate publicity resulting in increased traffic and increased play at such locations. In general, games that are popular are those having a game concept that is quickly and easily understood by a prospective player.

Over the years there have been many games that incorporate a rotating wheel into the game concept. The motion of the wheel servers as an attraction and the wheel provides for a manner in which to provide a number of targets that allow the exercise of skill. While there are numerous amusement games that have employed a wheel within a game concept including games that have been commercially sold by Benchmark under the names Roll for Gold, Claim Jumper, and Wheel Deal. A game called Smokin Token involved the insertion of coins to a jump wherein a player tried to time the insertion so a coin would roll down a ramp tan pass through a target aperture in a rotating wheel. Although these games, often referred to as "token action games" because the token is the game piece have been popular, the game event is over very quickly and the player may not be satisfied.

SUMMARY OF THE INVENTION

This present invention relates to new a coin operated amusement device wherein, upon activation of the device, a player is provided with a predetermined number of game pieces that can be introduced to play by activation of a solenoid release. In the preferred embodiment the game pieces are balls that are preferably made of an elastic material that allows the ball to bounce off surfaces of the game. The game may be designed to randomly award prizes or award prized based upon the exercise of skill. The object of the skilled based game is to time the activation of a solenoid that releases the balls above a moving playfield so that they will free fall from an upper guide toward the moving play field and drop through an aperture. In the preferred embodiment the playfield is a rotating wheel that is oriented so that it faces the location of the guide. If the player successfully times the release drop of the balls from the guide, the ball will fall though the aperture and an optical sensor will detect the ball as it passes through the hole. If the players timing is off, the ball will bounce up from the rotating wheel, bounce around in the play area, and eventually randomly fall through one of the holes on the rotating wheel.

In an alternative embodiment, a number of balls are rapidly released from the holding area at a location of the wheel that is not in axial alignment with any of the apertures in the rotating wheel. The balls then will then bounce and roll until each ball is captured within one of the holes or cavities provided through the wheel. Each of the apertures is provided with a symbol or number, similar to a slot machine. When the final ball is trapped, a central controller then detects the location of each of the balls and determines if the symbols or numbers match a predetermined result. If the symbols or numbers match the predetermined result, an award is provided such as tickets or a jackpot.

DETAILED DESCRIPTION

Figure 1:
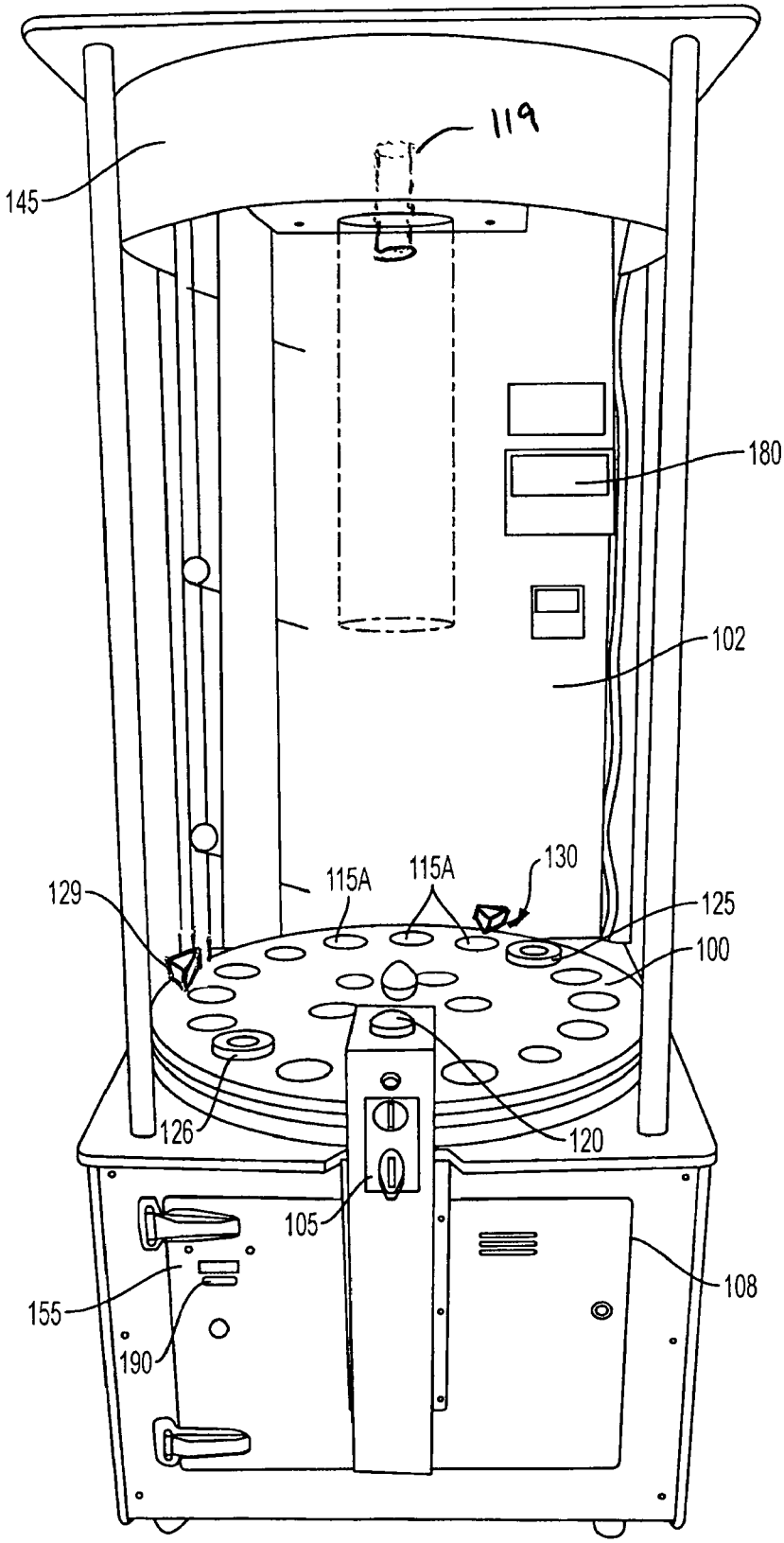
FIG. 1 is a perspective front view of a first embodiment of the invention.

Now referring to FIG. 1, the invention includes a rotating wheel 100 that is driven by a motor (not shown), that is enclosed by a transparent case 102. The device has a coin or token acceptor 105 on the front of the cabinet 108 that can accept genuine coins or tokens. Upon the detection of a genuine coin, switch 120 is activated by a game controller. The wheel 100 is rotated at a constant rate so that the location of a particular aperture can be predicted by a player.

Apertures or holes 115A that go through the wheel may be provided with different sizes and different point values may be ascribed to different sized holes. In a first skill-based embodiment, the object of the game is to time the activation of switch 120 so that a ball is released from a holding area located at the top of the game and allowed to drop though guide 119 and toward the rotating wheel 100 to coincide with an aperture passing the vertical axis on which the ball is falling. Different values may be ascribed to different apertures. In an alternative embodiment, a similar structure is used as recited above but the scoring methodology is altered and the holes are provided with corresponding symbols or colors rather than point values.

In the preferred embodiment the balls that are used in the device are high energy, elastic balls, sometimes referred to as "superballs" that will bounce off the surfaces including the wheel and the transparent wall encasing the wheel. Impediments, such as cubes and pyramids may be provided on the rotating wheel and the transparent wall to increase the bouncing of the balls in the play area and provide a random motion to the balls. In the gaming alternative, multiple balls can be released immediately following one another or at the same time so that multiple balls are bouncing round in the play area at one time. This provides a pleasing visual effect that may attract players to the game. In this regard, in a contemplated alternative embodiment the game, an attract mode is provided wherein multiple balls are released and allowed to bounce around inside the play area until they fall inside one of the holes. If the balls stop bouncing, they will roll around on the wheel until they fall into a hole. An impediment 129 and impediment 130 are also provided on the transparent wall sidewall near the edge of the wheel 100 and at a position so that it will to prevent the balls from moving to the periphery of the wheel and getting stuck there. A ball that is no longer bounding may traveling around the wheel and will strike impediment 129 or 130 and be propelled toward the center of the wheel or away from the sidewall. Although the impediments that are depicted are triangularly shaped, other shaped impediments would also satisfactorily accomplish this function. As depicted in FIG. 1. some of the apertures may be provide with a cylindrical collar 125 and 126 that prevent the balls from rolling into the holes. These collars may also cause the balls to bounce and roll in an unpredictable manner.

While the preferred embodiment contemplates the use of balls, other objects could be advantageously used with the invention. For example objects that did not bounce could be used and a guide provided across the wheel could be used to then remove the object from the wheel. For instance a stationary bar could be posited above the wheel that would engage objects resting on the wheel and cause them to fall off the periphery of the wheel. For instance, in a contemplated embodiment, bean bags of any shape or form could be used. In addition to balls other shapes such as cubes, tokens, pyramids, or rods could be released. The objects could bounce or have little or no ability to bounce.

In addition to using coins or tokens, it is contemplated that the game can accept debit cards or credit cards to activate the game. Coin acceptors and electronic debits devices for amusement machines are commercially available and well known in the art. An award may be distributed to a player in the form of coins, tokens or tickets that may be redeemed for prized.

Figure 2:
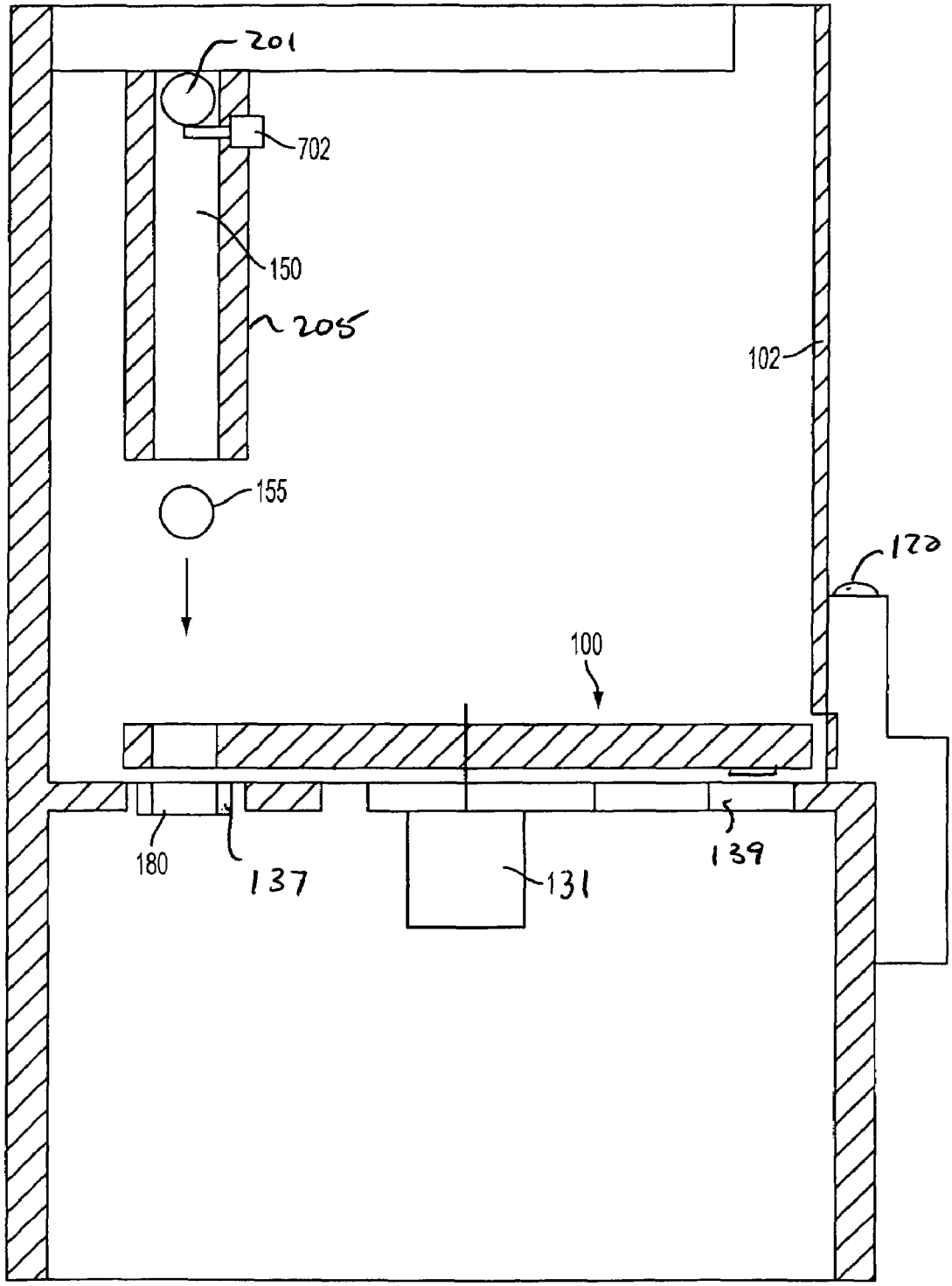
FIG. 2 is a side schematic view of the first embodiment of the invention in elevation.

Now referring to FIG. 2, in one embodiment of the game, the ball 201 that will be released may be visually inspected so that the player sees the ball as it is released by the solenoid 702. In this embodiment a guide tube 205 is oriented in a vertical direction above wheel 100. Upon the recognition of a credit, the controller will activate the switch 120 that controls the solenoid 702. In addition, the controller will provide a visual indicator in the form of an illuminated light within the switch which reflects that the game is in the play mode and the switch may be activated. Activation of the switch allows opens solenoid 702 to release the balls and fall through passage 150 toward opening 180. Wheel 100 is rotated at a constant speed by motor 131.

The balls that are successfully timed to drop through a hole will drop straight through the hole 180 and are immediately detected by the optical detector which sends a signal to the controller 137. A wheel location sensor 139 also sends signals to the controller and the control can then correlate the value of the particular target with the aperture through which the ball falls through. The drop is timed from the activation of the switch so that the controller can also determine if the ball traveled directly through the hole or it bounced around on the playfield for some time before it is detected. If the ball directly falls through a hole a first award may be provided. If the ball directly falls through the target hole an alternative award may be provided. In a preferred embodiment, if the player successfully times the drop so that the ball falls directly through an aperture, both audio and visual output is provided. A jackpot for successful play may include additional play to the player or be awarded in the form of tickets, tokens, or coins. For example, a higher award may be provided for a smaller hole. In another example, if a player successfully times a predetermined number of drops in direct sequence, an award may be increased. In yet alternative embodiments, the jackpot and payoff may be altered including using different targets and different bonuses depending on the play of the game. For instance if no one wins a jackpot over a predetermined number of iteration of play, the bonus may increase. This bonus may be award in addition to the values reflected on the target. A bonus value may be displayed to the player. In yet other contemplated, a collar around the aperture may be illuminated with diodes lights to indicate that a particular the target aperture is in a bonus mode.

If the ball does not immediately pass through the controller will not receive a signal form the optical sensors and interpret this as to successfully timed drop. The ball then may roll around in the playfield until it falls though any hole.

Figure 3:
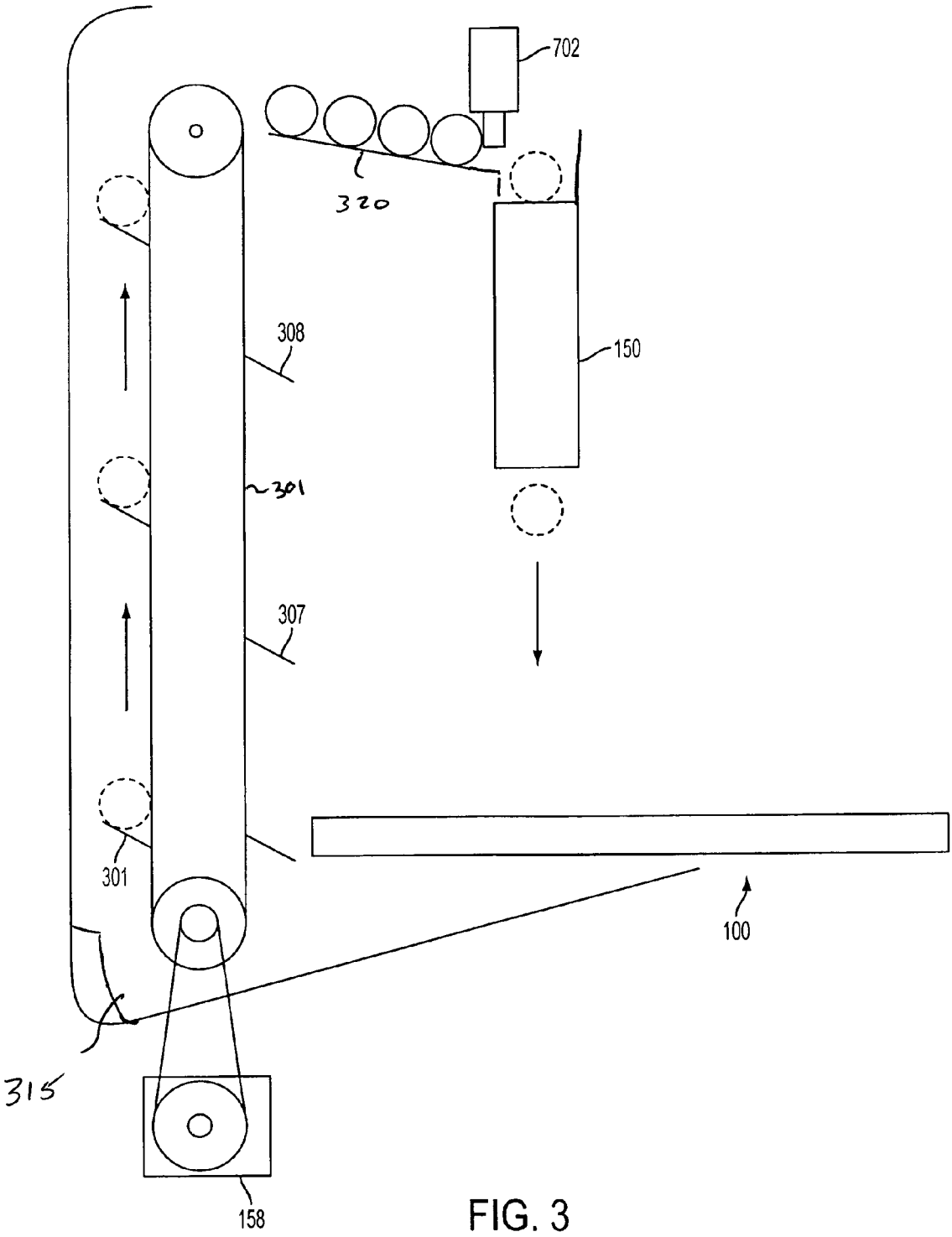
FIG. 3 is a side schematic view in elevation of the ball release solenoid, the ball guide, and a ball lift according to the invention.

As seen in FIG. 3, the balls are transferred to an upper retention area by a belt transfer system that includes belt 301 and ball capture extensions 307 and 308. The ball capture extensions engage balls located in reservoir area 315 and transfer balls to the top of the game cabinet to a retention area 320. The belt is driven motor 158.

Figure 6:
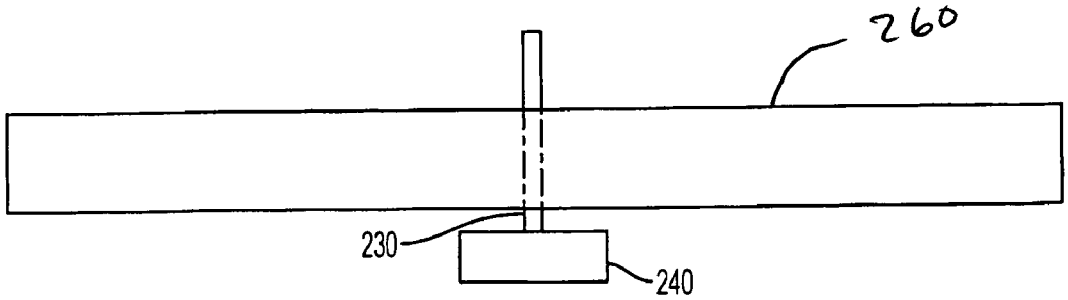
FIG. 6 is a side view of a version of the wheel showing the axle and the motor.

Wheel 100 may be drive by a frictional motor at the side of the wheel as depicted in FIG. 6 or it can be located underneath the wheel in the cabinet and be driven by a drive belt to the wheel axis. U.S. Pat. Nos. 6,889,328; 6,206,370, 5,967,515, 5,788,115 and 5,385,347 which teach inter alia different techniques for the detection of wheel positions and controller technology for amusement games are incorporated by reference herein.

Figure 4:
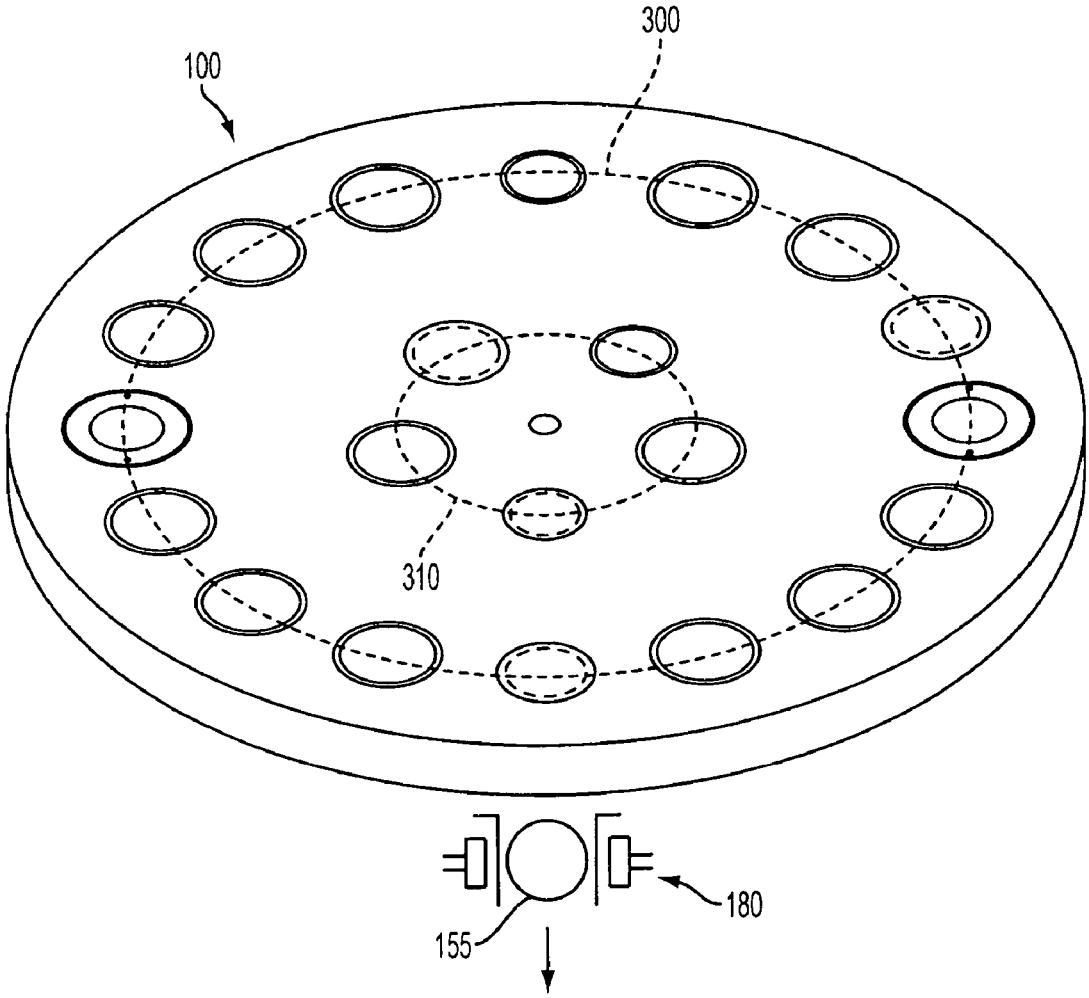
FIG. 4 is a schematic view of the wheel in the skill version of the game that shows includes an optic sensor for the outer ring of apertures through the wheel.

Now referring to FIG. 4, wheel 100 is depicted with a number of apertures having different sized opening. Positioned below wheel and under the guide, is located optical sensor 180 that comprises a light source and a light detector. As ball 155 passes through the path of light between the source and the detector, the light detector will not transmit a signal and this interruption of the signal will be detected by the controller as indicating that a ball as past through the aperture. The controller will then look up the value of the target based upon the wheel position and look up the time that the solenoid was released. The will then send a signal to the ticket distributor based upon the time elapses between the drop and the target and the value of the target.

Figure 5:
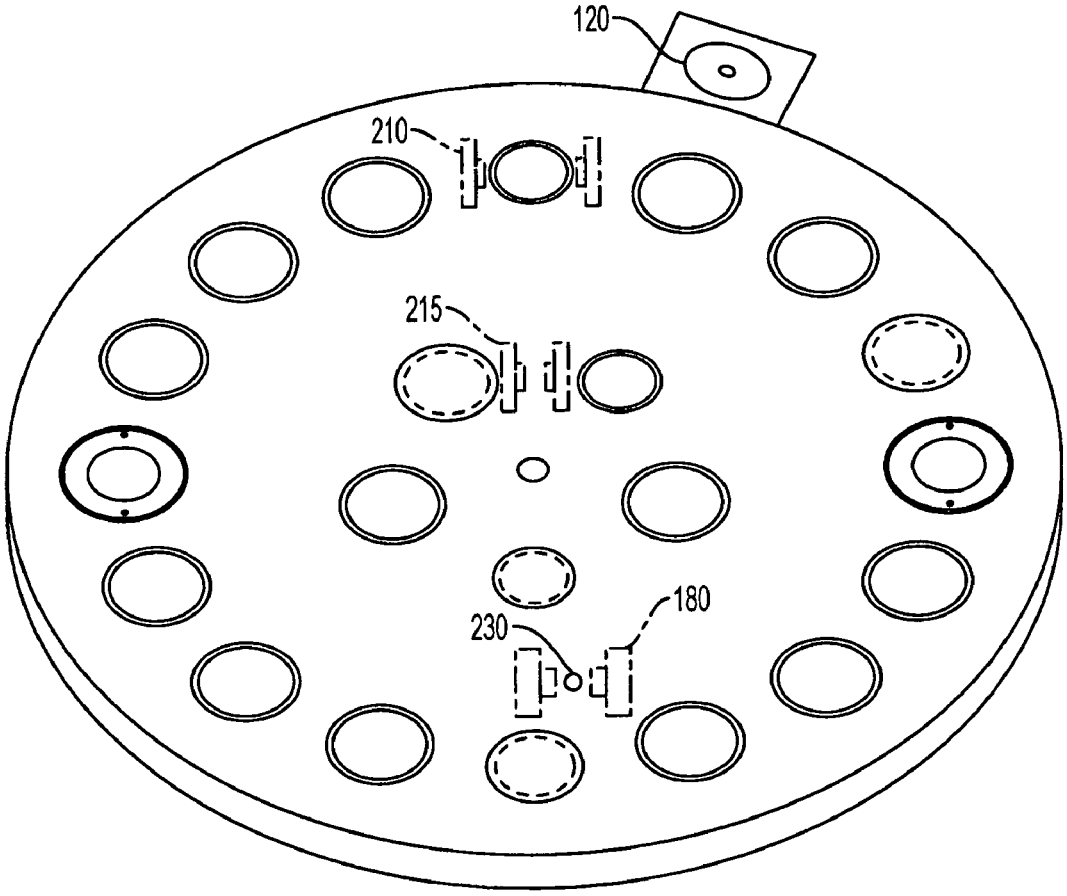
FIG. 5 is a top view of the skill game and includes the two hole sensors and a optical sensor that detects the position of the wheel.

Now referring to FIG. 5, in this embodiment there are optical sensors for the inside array of target apertures 215, the outside array of target apertures 210 and a home wheel position sensor 180 that detects a pin that extends from the lower surface of the wheel. FIG. 6 shows the axle 230 which drives wheel 260 which is attached to motor 240.

Figure 7:
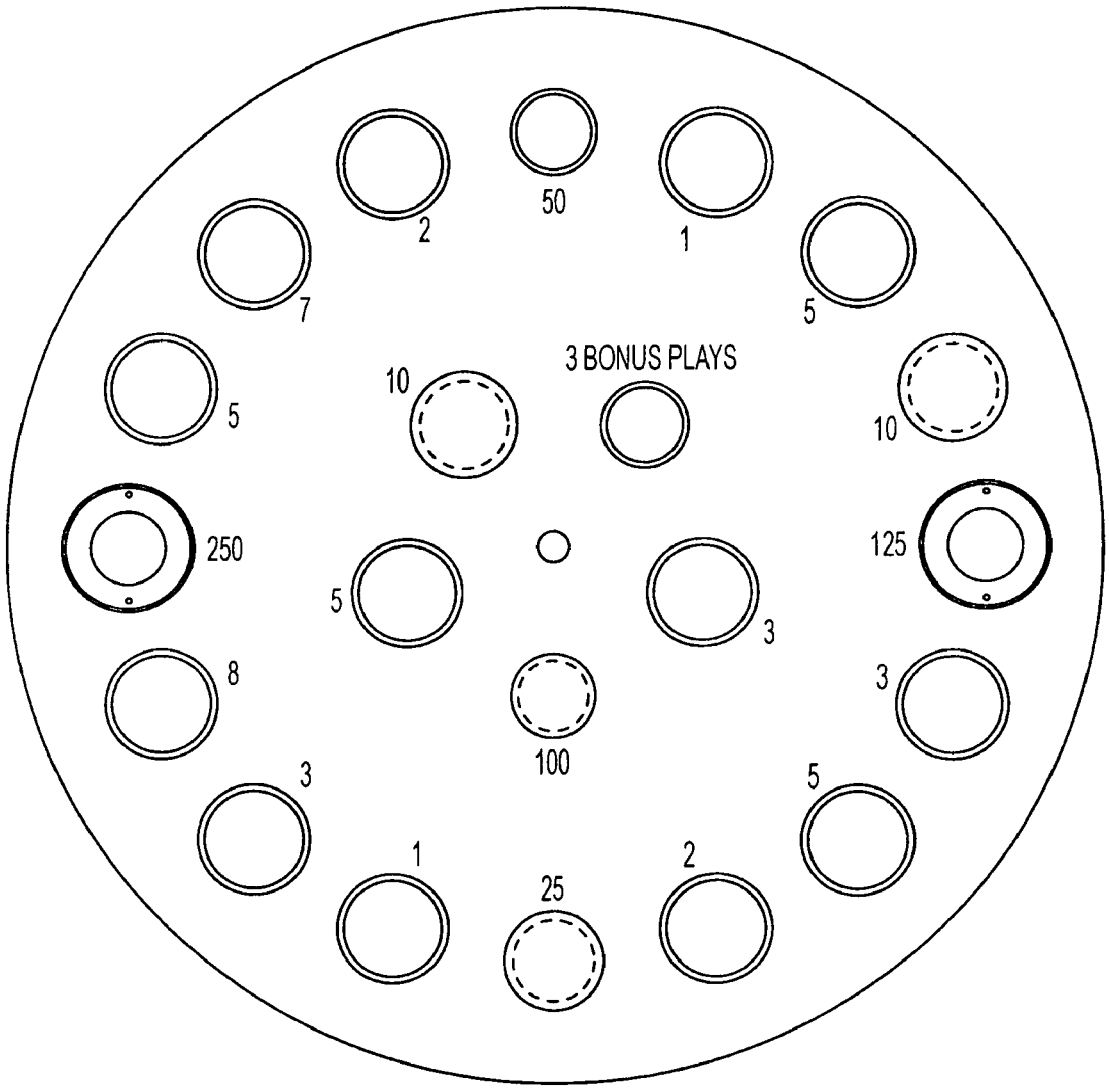
FIG. 7 is a top view of a version of the wheel where each hole is assigned a point value.
Figure 8:
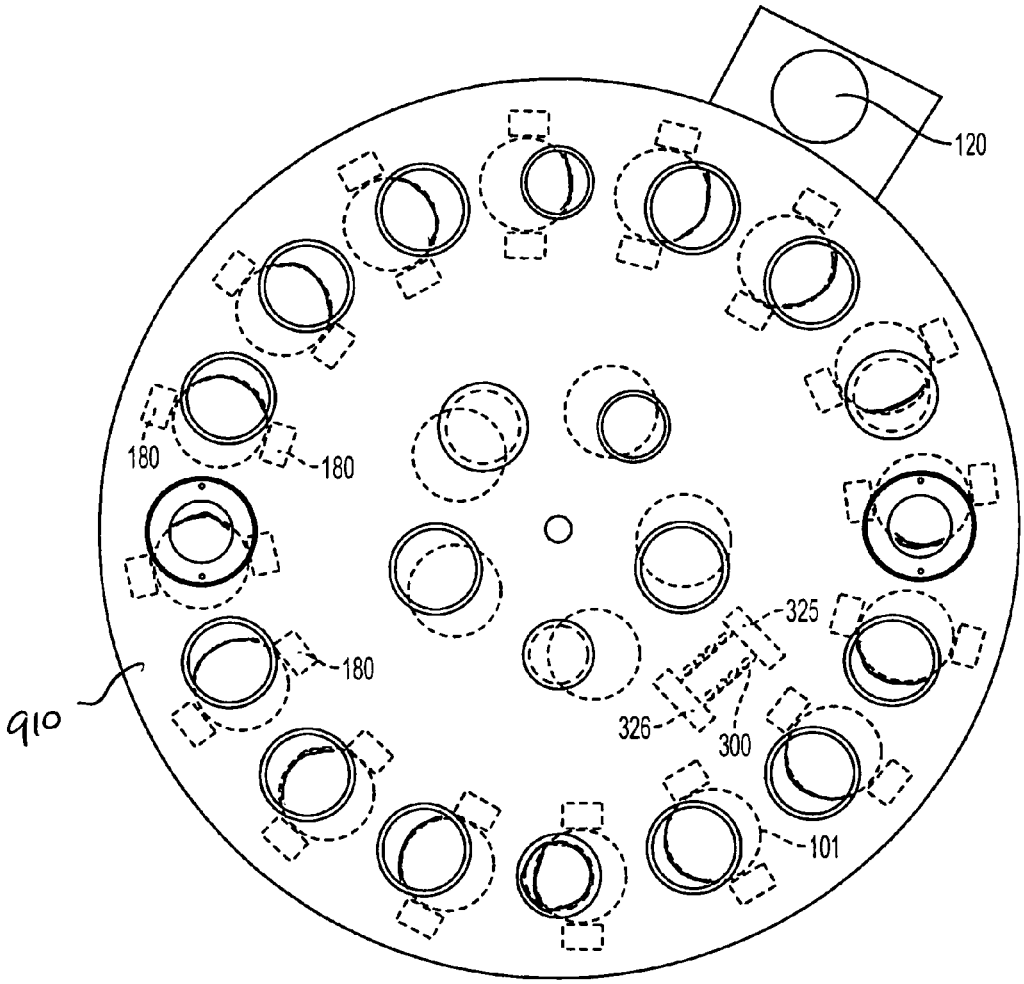
FIG. 8 is a top view of a second alternative embodiment of the invention wherein a plurality of the apertures are provided with an optical sensor.
Figure 9:
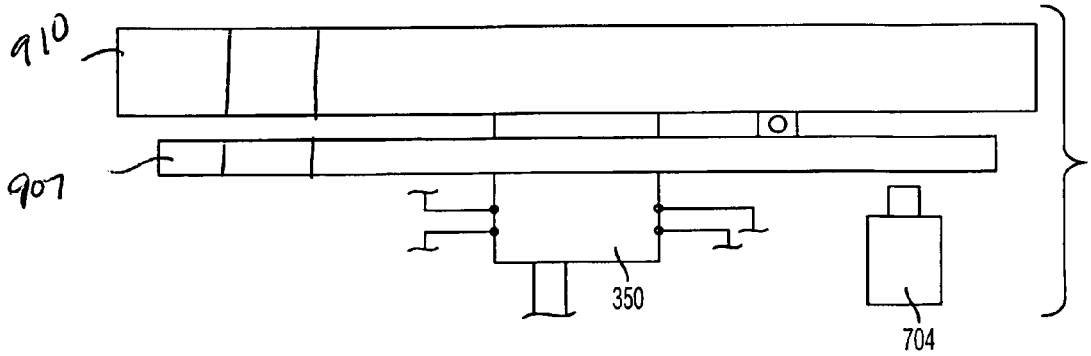
FIG. 9 is a side view of the embodiment depicted in FIG. 8. positioned below the top panel. Theses holes are offset and as a result the balls will remain trapped in the holes until the release panel is oriented in alignment with the holes in the top target wheel.

FIG. 7 depicts the top of a target wheel in an alternative embodiment wherein each of the target holes is provide with a value. In yet alternative embodiment this indication may be a symbol. In these versions of the game, a number of balls are dropped in rapid sequential order at a location above the wheel at a position that is not in axial alignment with any apertures. For example it could be in alignment with the annular section of the wheel between the outer and inner apertures. The balls bounce on the wheel surface and may enter any of the apertures provided in the wheel. As best seen in FIGS. 8 and 9, rather than falling directly through the wheel to the ball reservoir or collection area, the balls are trapped in the various holes by a retainer wheel 907 that is provided below the target wheel. As best seen in FIG. 8 the retainer wheel is offset from the target wheel so that the holes are not in direct alignment. The offset wheel is moved along with the target wheel during the play of the balls and the arrangement provides for the temporary retention of the balls in the holes. When all of the balls have been the captured by the holes, the solenoid 704 is engaged which provides force or drag on the retainer wheel 907. This drag overcomes a biasing force that is provided by spring 300 and allows the holes in the top wheel and bottom wheel to directly align with one another. When holes are in alignment, the balls will fall through the wheels and are allowed to travel to ball reservoir. This arrangement allows until the aperture in which the ball is temporarily retained or trapped is in alignment with a bottom aperture that allows the ball to a fall into a lower ball retention region. When the ball is retained by the wheels they can be detected by detectors 180 which are provided for each of the target holes.

As discussed above, in the second general embodiment of the game the play and the game piece's association with the aperture e is a completely random event. In this embodiment a player activates the game and then a predetermined number of balls are release through a guide toward the rotating playfield. In this embodiment the balls are released from a location that is not in vertical alignment with the apertures on the wheel so that the initial engagement with the wheel will cause the balls to bounce off the wheel and continue to randomly bounce and roll within the confines of the play area until they comet to rest in one of the cavities provide through the wheel.

One advantage of the game is that the player is free to inspect the play and action of the game and can be assured that there is no cheating or bias towards the gaming establishment. In this regard, one problem with slot machine and other electronic games is that players suspect that the game is not entirely fair, but rather believe that the chance of winning is not an entirely random event but may be preordained by manipulation of the electronics of the system. While in some respects the odds in connection with some electronic games may be set by the operators, and player's suspicions are therefore not entirely without merit. There is sense among some players that this practice is not fair. The present game has the advantage of allowing the player to see the entire game action and can thereby be confident that the game is not programmed in favor of the house.

Figure 10:
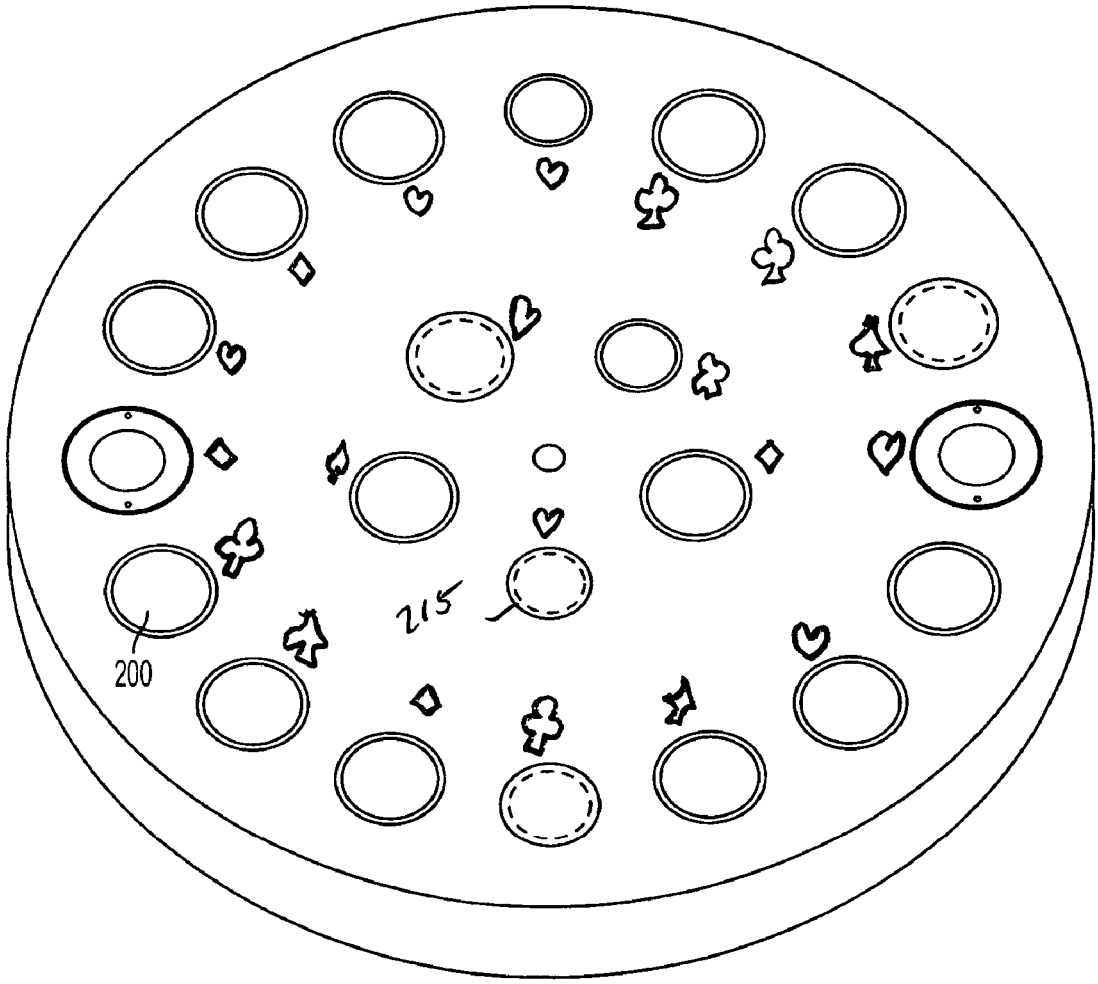
FIG. 10 is a top view of the wheel used in the casino or gaming version.

Now referring to FIG. 10, the wheels may be provided with different sized or shaped openings. For instances the prize for having a ball pass through or being retained in hole 200 may be less than hole 215. Various awards can be preset depending and different graphics may be provided on the wheel. For example, a symbols such as hearts, diamonds, spades and clubs may be associated with holes and in a player successfully has a ball enter four of a kind, an award can be provide. This four of a kind may be programmed for a skill game where a player attempts to sequentially drop the ball through four similar marked apertures or the four of a kind could be associated with the random game.

Figure 11:
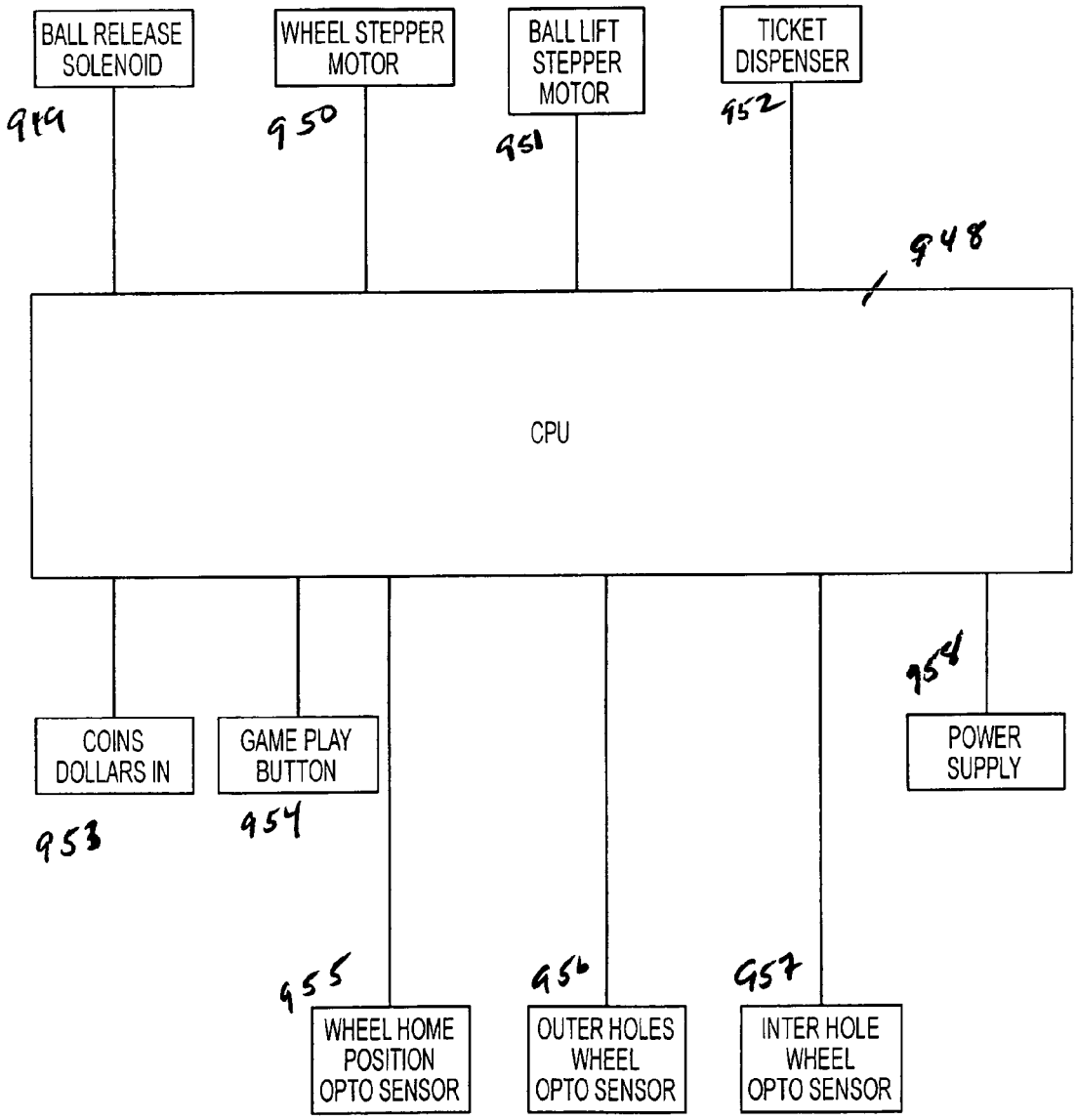
FIG. 11 is a schematic view of the controller and the various inputs and outputs if or the skill game or arcade model. f.

FIG. 11 depicts the inputs and outputs to the central processing unit or controller 948 in the first embodiment of the game including a ball release solenoid 949, a wheel motor, a ball lift motor 951 a ticket dispenser 952, The received input from the coins dollars in acceptor 953 to activate game play button 954. Wheel home position opto sensor 955 provides signals to the CPU to allow the CPU to correlate the position of the wheel at any particular time. Also shown is an outer hole wheel optical sensor 956 and inner hole wheel sensor 957 which dectect the balls as they pass through the holes. The CPU is powered by power supply 958 which also powers the various solenoids, switches and motors and sensors.

Figure 12:
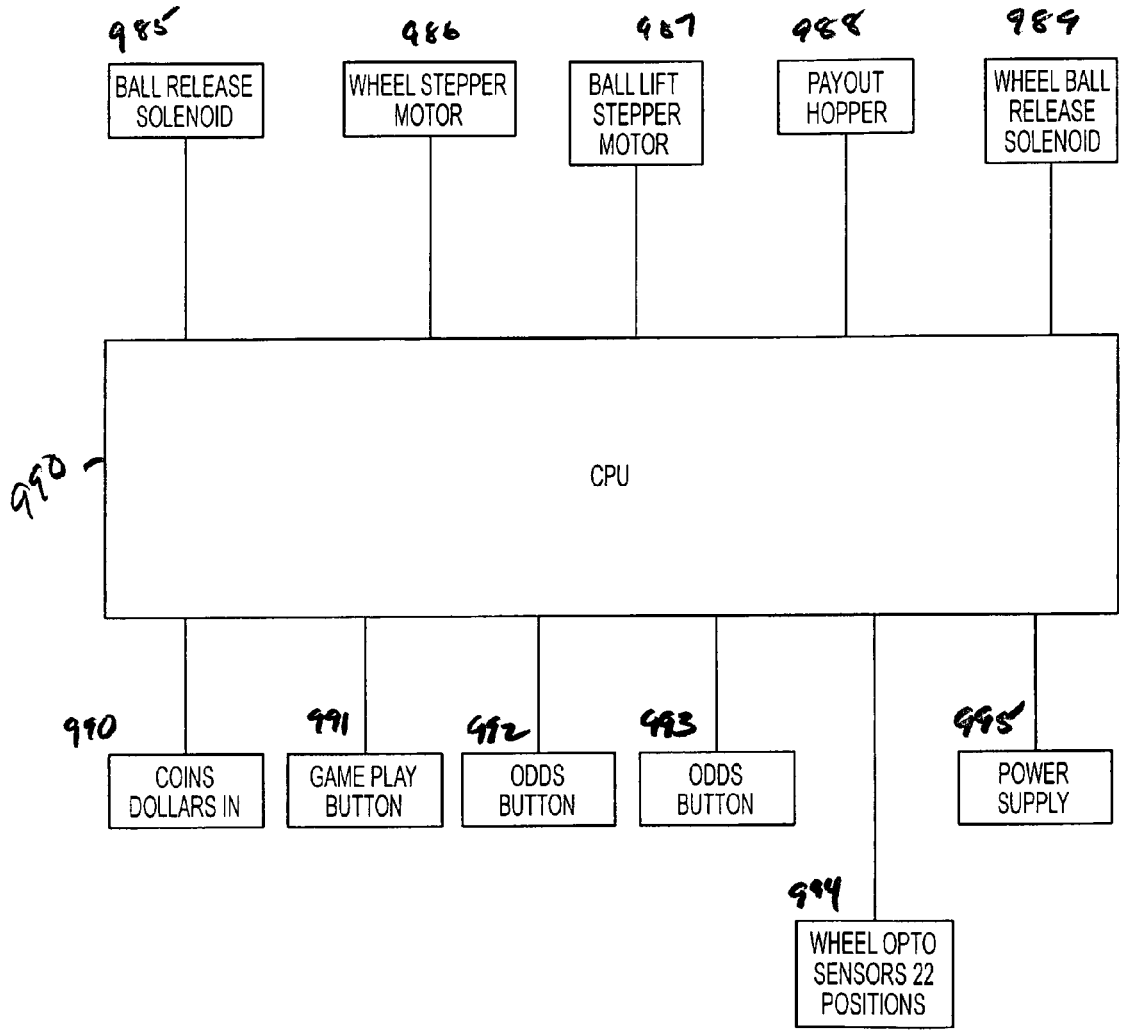
FIG. 12 is a schematic view of the controller and the inputs and outputs of the casino model.

FIG. 12 is a schematic depiction of the input and output to a CPU 990 in connection with a second embodiment of the invention. Like the first embodiment the input and output includes a ball release solenoid 985, a wheel motor 986, a ball lift motor 987. In this embodiment the CPU controls a payoff hopper 988 which may award tokens or other prizes to a player. The wheel ball release solenoid 989 engages the retention wheel to directly align with the target apertures and allows the balls that are trapped in the holes to fall to the ball retention area. The CPU activates the game play button 991 to release a predetermined number of balls. The odds buttons 992 and 993 allow the operator of the game to change the payout depending on a number of predetermined outcomes. For instances the operator may want to increase the payout if a wheel has smaller opening or in the event that four of a king are detected. In this embodiment, each of the holes in the wheel has its own sensor which is reflected by wheel optical sensor 994. Like the previous embodiment, a power supply is provided.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

We claim:

1. An amusement device comprising a wheel having at least one aperture provided through said wheel, means to rotate said wheel at a substantially constant rate, a game piece, means to release said game piece from a release location above said wheel, and allow said game piece to fall, detection means associated with said aperture, wherein said game piece is detected by said detection means when it passes through said aperture and, said aperture passes under and comes into in direct vertical alignment with said release location as said wheel is rotated.

2. The amusement device as recited in claim 1 wherein said game piece comprises an elastic polymer and will therefore bounce when it is dropped upon said wheel.

3. The amusement device as recited in claim 2, wherein said game piece comprises a ball.

4. The amusement device as recited in claim 1 wherein said wheel is substantially flat and rotates in a substantially horizontal plane.

5. The amusement device as recited in claim 1 wherein said wheel comprises a plurality of apertures.

6. The amusement device as recited in claim 5 wherein said plurality of apertures further comprise different sizes.

7. The amusement device as recited in claim 6 wherein said device further comprises wheel position sensors and means to correlate the position of said wheel with the time in which said game piece passes though said aperture.

8. The amusement device as recited in claim 1 further comprising means to transfer said game pieces from a collection area to a release area above said wheel.

9. The device recited in claim 7 further comprising a controller and a ticket dispenser, wherein said controller receives signals from said wheel detector, a ball detector and ball release means detectors and the coin acceptor and transmits signals to a ticket dispenser and to activate said ball release means and said controller processes information from said detectors to determine whether or not the player has successfully timed a drop and wherein in response to a signal from said controllers, said ticket dispenser will distribute a predetermined number of tickets.

10. The device as recited in claim 1 further comprising impediments that extend from a surface of said wheel and said impediments may come into contact with said game pieces and cause said game pieces to move in an unpredictable manner.

11. An amusement device comprising an element rotating on an axis and having a plurality of apertures provided through said element, a motor to rotate said element, at least one game piece, a pathway that allows a plurality game pieces to move from a location below said element to a guide that is positioned above said element, wherein said guide aligns said game pieces to a release position above said rotating element and allows the release of said game pieces toward said element, and wherein at least one aperture passes under and comes into direct vertical alignment with said release position as said element is rotated, at least one detector associated with said apertures, said detector providing a signal in response to the association of a game piece with said apertures, wherein said game piece may be detected by said detection means when it falls within one of said apertures, and a wheel location detector to detect the angular position of the wheel wherein the controller can correlate the signal from the aperture detector with the wheel detector and provide an award.

12. The amusement device as recited in claim 11 wherein said element is a wheel.

13. The amusement device as recited in claim 12 wherein said wheel is substantially flat.

14. The amusement device as recited in claim 12 wherein said wheel has a number of projections that cause said game pieces to appear to randomly bounce on said wheel.

15. The device recited in claim 1 further comprising a retention wheel to temporality retain said game pieces within the aperture.

* * * * *